United States Patent [19]

Irwin

[11] 3,946,397

[45] Mar. 23, 1976

[54] INDUCTOR OR ANTENNA ARRANGEMENT WITH INTEGRAL SERIES RESONATING CAPACITORS

[75] Inventor: James S. Irwin, Ft. Lauderdale, Fla.

[73] Assignee: Motorola, Inc., Chicago, Ill.

[22] Filed: Dec. 16, 1974

[21] Appl. No.: 532,989

[52] U.S. Cl. ..... 343/788; 336/69

[51] Int. Cl.[2] ..... H01Q 7/08

[58] Field of Search ..... 343/744, 787, 788, 895; 336/69

[56] References Cited

UNITED STATES PATENTS

| | | | |
|---|---|---|---|
| 3,427,624 | 2/1969 | Wanselow et al. | 343/895 |
| 3,573,840 | 4/1971 | Couillou et al. | 343/895 |
| 3,721,989 | 3/1973 | Christensen | 343/788 |

*Primary Examiner*—Eli Lieberman

*Attorney, Agent, or Firm*—Donald B. Southard; James W. Gillman

[57] ABSTRACT

An improved inductor arrangement suitable for a wide variety of applications, but particularly advantageous for use in the design of ferrite antenna structures intended to operate at the relatively higher frequencies. The disclosed inductor arrangement includes a spiral inductor or coil divided into a plurality of wire segments, respective pairs of which are interconnected by individual capacitance elements to form a plurality of series-resonant circuits at a particular frequency or range of interest. The capacitance elements may be provided in the form of discreet components or by a suitable electro-deposition process in the interests of further optimizing size factor. The number of individual wire segments and resonating capacitance elements may be selected to provide a given terminal impedance for the inductor arrangement within a certain limited design range.

8 Claims, 5 Drawing Figures

INDUCTOR OR ANTENNA ARRANGEMENT WITH INTEGRAL SERIES RESONATING CAPACITORS

BACKGROUND OF THE INVENTION

This invention relates in general to series-resonating circuits and more particularly to an inductor arrangement with a plurality of integral series-resonating capacitors and which is suitable for use in a subminiature ferrite antenna exhibiting relatively high gain yet being substantially insensitive to hand capacity effects or the like.

In portable radio and paging equipment and related applications, size is of course an extremely important factor. At the same time, no degradation and performance can be tolerated to any large extent. This is particularly so with respect to antenna apparatus. High gain response is most desirable and, indeed, critical if the full range capabilities of the radio or paging equipment is to be realized. However, because of size limitations, the associated antenna arrangement cannot take the usual form of high gain antenna configurations conventionally encountered in the mobile communication or television arts.

One way to achieve an effective compromise between gain and size factors is to employ a ferrite rod antenna for such radio apparatus. This is a magnetic antenna structure as contrasted to the usual electric antenna structure. As is known, magnetic antenna devices of this sort are usually in the form of a rod or cylinder of ferrite material on which a spiral conductor is wound. The spiral conductor forms a completely closed loop and the ferrite core serves to concentrate the magnetic lines of flux and thereby induce an appropriate voltage signal in the closed loop configuration.

The conventional ferrite antenna structure nevertheless has a number of disadvantages, particularly at the relatively high frequencies at which the communications or paging receiver apparatus is expected to operate, say in the UHF frequency range, where problems in effectively resonating the antenna apparatus may be experienced. Too many turns of conductor on the ferrite core results in an inductance which in turn makes the necessary capacitance for resonance simply impractical. That is, the value of the capacitance becomes inordinately small. Reducing the number of turns to obtain a more practical value of resonating capacitance, however, reduces the level of induced voltage and thus is counter-productive with respect to gain.

Moreover, at the higher frequencies, hand capacity, while of a relatively low value, nevertheless presents an alternate or parallel path of sufficiently low impedance to significantly increase the loss factor with respect to the antenna device as a whole. The term "hand capacity" in this regard is used generally to denote one capacitive effect produced by the close proximity of the antenna device to any part of the human body.

Accordingly, it is an object generally of the present invention to provide an improved subminiature antenna structure suitable for use in paging or portable radio apparatus, which antenna structure effectively overcomes the foregoing method deficiencies.

A more particular object of the present invention is to provide a subminiature ferrite antenna structure suitable for use in paging and portable radio communications apparatus operable in the VHF or UHF frequency ranges and which exhibits improved gain characteristics.

Another object of the present invention it to provide an improved subminiature ferrite antenna device of the foregoing type which is substantially insensitive to hand capacitance effects or other loss factors when placed in close proximity to or worn on the person by a prospective user.

It is to be understood that while the present invention may be applied most advantageously to the application of antenna design, and particularly to the design of ferrite antenna structures, it is not limited thereto and may well find appropriate utilization in a wide variety of applications which will become apparent to those skilled in the art.

Accordingly, it is a further object of the present invention to provide an inductor arrangement with a plurality of integral series resonating capacitors for selective control of the terminal impedance of such inductor device without regard to the level or magnitude of inductance involved.

SUMMARY OF THE INVENTION

In practicing the invention, an inductor arrangement is provided in the form of a helical coil or other spiral configuration wherein the inductance is cut or otherwise divided into individual wire segments interconnected by a plurality of series resonating capacitors. In the preferred embodiment, each wire or inductive segment is individually series resonated at the particular frequency of interest. In this way, the terminal impedance of the inductor arrangement can be selectively controlled to a large extent dependent of the actual level or magnitude of inductance involved.

In application, the present invention is particularly suited for adaptation to the design of ferrite antennas, particularly such antennas intended for operation at the higher frequencies, say, in the VHF and UHF frequency ranges. The inductor device is preferably in the form of a thin metallic ribbon cut into selective segments, interconnected by a plurality of capacitance elements, and wound on an associated ferrite core or rod member. A higher number of turns can thereby be provided on the ferrite core to significantly increase the level of voltage induced in the overall antenna structure, and thereby the relative gain, while rendering the antenna structure substantially insensitive to hand capacitive effects that may otherwise be generated when the device is placed in close proximity or worn on the person of a user.

BRIEF DESCRIPTION OF THE DRAWINGS

The features of the present invention which are believed to be novel are set forth with particularity in the appended claims. The invention itself, however, together with further objects and advantages thereof, may be best understood by reference to the following description when taken in conjunction with the accompanying drawings, in which:

PREFERRED EMBODIMENTS OF THE INVENTION

Figure 1:
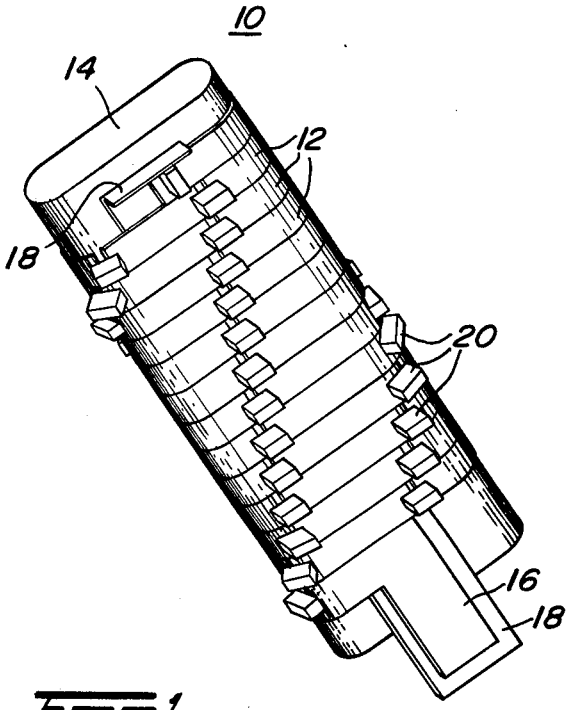
FIG. 1 is a view in perspective of a ferrite antenna device, which antenna has been constructed in accordance with the present invention.

Referring now to the drawings, an improved ferrite antenna structure 10 is shown in FIG. 1 which has been constructed in accordance with the present invention. Antenna 10 includes a spiral conductor 12, preferably in the form of a flat metallic ribbon, wound about a ferrite core 14 in substantially the manner as indicated. Connecting terminals 16 and 18 are formed by the respective ends of the conductor 12.

Figure 2A:
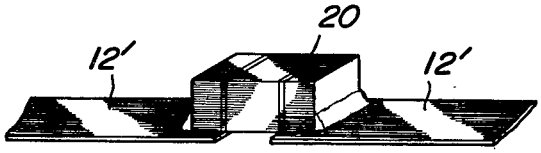
FIG. 2a is an enlarged partial view in perspective of a pair of wire segments forming a part of the antenna of FIG. 1 and interconnected by a capacitance element in discreet form.
Figure 2B:
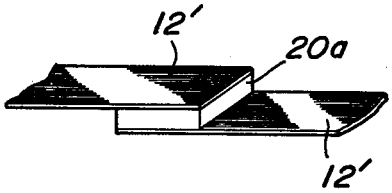
FIG. 2b is an enlarged partial view in perspective of a pair of similar wire segments interconnected by a capacitance element which has been electro-deposited between overlapping end portions.

As further shown in FIG. 1, and more particularly in FIGS. 2*a* or 2*b*, the flat metallic ribbon conductor 12 is cut into a plurality of individual wire segments 12′. These segments are in turn interconnected by a plurality of capacitance elements 20, the purpose of which will be detailed subsequently.

As known in the art, the antenna structure 10 as depicted in FIG. 1 is commonly referred to as a ferrite antenna. As such, it is a magnetic antenna arrangement as distinguished from the more frequently encountered electric antennas. In structures of the latter type, one or more active elements are provided to intercept electromagnetic energy which in turn induces an appropriate voltage therein. They are characterized in that they are in open loop form and are either end or center fed. Such antennas usually incorporate straight rod like elements of one sort or another and have physical lengths for responding to particularized frequencies.

The magnetic antenna, on the other hand, includes a closed loop formed by a plurality of turns of wire or conductor about a magnetic core in which magnetic lines of flux are effectively concentrated, depending upon the permeability factor. In any event, the length of the wire conductor itself is not critical since resonance at the desired frequency of operation may be achieved by a series or parallel capacitance interconnected with the spiral conductor serving as the inductance in the overall reactance circuit.

In this regard, it will be appreciated that it is customary and of course desirable to incorporate as many turns of wire conductor as possible, within design limits, on the magnetic core so as to optimize the induced voltage, and thereby overall antenna gain. A relatively high number of turns is obtainable for such antenna structures operating at the lower frequencies, say, for example, in the AM and FM radio broadcast ranges. This is primarily because the required resonating capacitance is nevertheless of a practical value. This is not the case for the higher frequencies. For frequencies in the UHF range, for example, only two or three turns of conductor are possible on the magnetic core or else the necessary resonating capacitance becomes inordinately small, and therefore completely impractical, for example, one picofarad or less. Simply reducing the number of turns on the core to increase the value of resonating capacitance is counterproductive in that for every turn less of wire conductor on the magnetic core, there is a corresponding decrease in the induced voltage therein.

Still another problem is ferrite antenna devices of the type here considered concerns the alternate current paths that may be presented or otherwise created when the antenna device is placed in close proximity to or worn upon the person of a prospective user. "Hand capacity effects" is a common reference for this particular phenomena. As will be appreciated, the loss factor for the antenna device is significantly increased whenever this occurs. The problem is of course accentuated at higher frequencies where even a very small capacitance presents a parallel path of low impedance that substantially degrades the performance of the associated antenna device.

These problems, however, are readily and efficiently overcome in accordance with the principles of the present invention, as embodied in FIG. 1. As therein depicted, the wire conductor 12 forming the closed loop on the core 14 is intentionally cut or divided the plurality of individual wire segments 12′. The wire segments 12′ are then serially interconnected by a plurality of capacitance elements 20. In this way, the resonating capacitance is physically distributed within the coil. Moreover, assuming the value of capacitance is the same for each of the interconnecting capacitive elements 20, the total capacitance for series resonance with a total inductance of coil 12 is simply C divided by X, where C is the capacitance value of a single capacitive element 20 and X is the total number of such capacitance elements.

It will be readily apparent, then, that a higher number of turns of wire conductor can be effectively utilized by virtue of the arrangement as shown in FIG. 1 than would otherwise be possible. Each of the wire segments is individually tuned or resonated to the frequency range of interest. In this way, as long as the reactance values of the individual elements are practical, additional segments, which in turn create additional turns about the associated magnetic core, can be added as desired without substantial affect.

Hand capacity effects are likewise minimized since the impedance at every point is reduced with respect to every other point and the parallel impedance paths that may be generated by close proximity to the person of a user are nevertheless not low enough to significantly increase the loss factor of the antenna device as a whole.

It is to be understood that the capacitive elements 20 may be provided in a wide variety of circuit configurations. They may be conventional in form such as ceramic discs, tubular, etc. As indicated in FIG. 2*a*, they may take the form of miniature glass or ceramic pads with conductive end terminals for soldering to the conductor wire segments 12′ as shown. This provides an overall configuration that is attractive in terms of both fabrication and size factors. Of course, there are other configurations that may be readily utilized and remain within the scope of the present invention. For example, capacitive elements 20*a* may be provided by a deposition process between overlapping terminal portions of the wire segments 12′, as depicted in FIG. 2*b*. In this embodiment, size and appearance are still further optimized.

As mentioned previously, the present invention is not limited to antenna design applications, but may find advantageous use in any application where a series-resonant tuned circuit is to be required and where the specific value of terminal impedance is a factor. By choosing the number wire segments and associated capacitive elements to be employed, any desired value of terminal impedance can be effectively obtained within certain practical design limits. Moreover, for higher power circuits, the high voltage point normally existing at the junction of the inductive and capacitive reactance elements, in the conventional single element circuit, is effectively obviated. With a plurality of such reactive elements, the reactive impedance is reduced accordingly, which in turn reduces the voltage levels being generated.

An inductor constructed in this manner will have the same bandwidth as the conventional single inductive-capacitive element tuned circuit. Moreover, there will be no degradation of circuit Q if the Q of the individual capacitive elements is substantially the same as the Q of the original single capacitor in a one-capacitor network.

Figure 4:
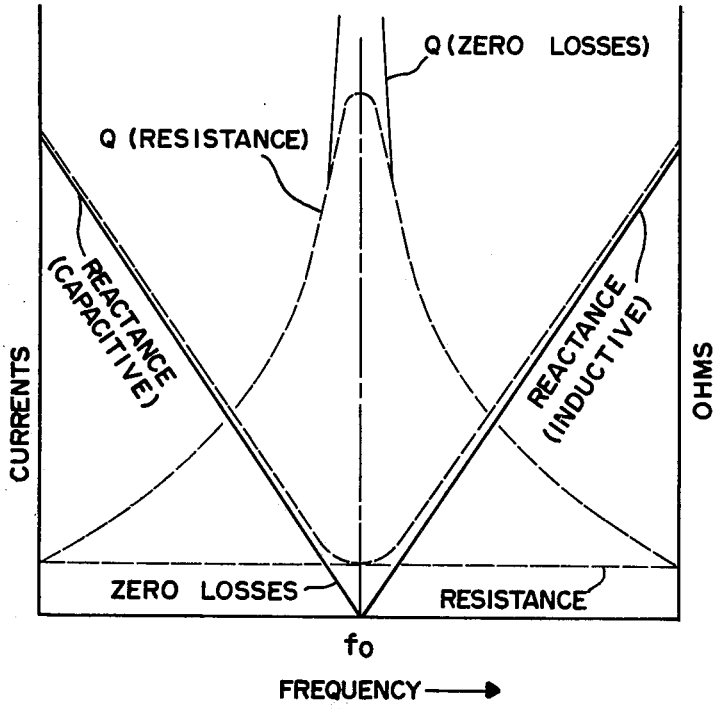
FIG. 4 is a graphic representation of the response characteristics of a series-resonant circuit which may be useful in understanding certain aspects of the present invention.
Figure 3:
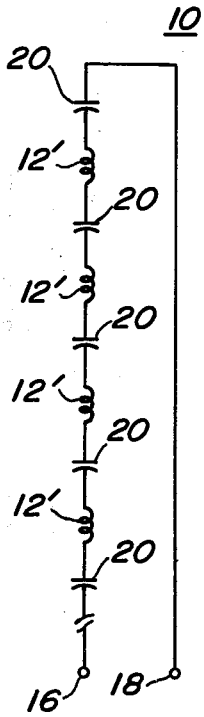
FIG. 3 is a schematic representation of the closed loop conductor forming a part of the antenna structure of FIG. 1.

FIG. 4 illustrates the response characteristics that may be expected of a series tuned circuit in terms of impedance and circuit Q. As such it is applicable to series-resonant circuits generally, whether embodied in an antenna circuit arrangement or in a more highpowered electrical circuit as a simple series-resonant inductor arrangement.

Accordingly, an improved inductor arrangement with interval series-resonating capacitors has been set forth and described herein which is suitable for general application, but particularly advantageous in a design of ferrite antenna structures operable at the higher frequency ranges. It is relatively simple in operation, yet highly efficient and reliable. Size is not compromised and fabrication costs are maintained at an attractive level.

While particular embodiments of the present invention have been shown and described herein, it will be apparent to those skilled in the art that various changes and modifications may be made without departing from the invention in its broader aspects. As a consequence, the aim in the appended claims is to cover all such changes and modifications as may fall within the true spirit and scope of the invention.

What is claimed is:

1. An improved series-resonant inductor circuit component arrangement, comprising in combination:

a wire conductor of a predetermined length wound in helical form of substantially uniform diameter and having respective ends for connection to associated circuitry, said conductor being divided into a plurality of individual wire segments, each capable of resonance at a particular frequency of interest; and a plurality of series-resonating capacitors individually interconnecting a respective pair of said inductor wire segments, respectively, to form a plurality of series-resonant tuned circuits, the number of said wire segments and said series-resonating capacitors being selected to determine generally the terminal impedance of said inductor arrangement presented at said terminal ends.

2. An improved series-resonant inductor arrangement in accordance with claim 1 wherein said plurality of series-resonating capacitors are provided in descreet component element form.

3. An improved series-resonant inductor arrangement in accordance with claim 1 wherein said plurality of series-resonating capacitors are provided as thin, insulating pads suitably deposited between overlapping end portions of said respective pairs of said inductor wire segments.

4. An improved loop ferrite antenna arrangement effectively desensitized to hand capacity effects, comprising in combination:

a ferrite magnetic core;

a spiral conductor wound on said core as a closed loop, said conductor being divided into a plurality of wire segments capable of individually resonating within a particular frequency range of interest; and a plurality of series-resonating capacitors individually interconnecting respective pairs of said wire segments to form a plurality of series-resonant tuned circuits within said frequency range of interest.

5. An improved ferrite antenna arrangement in accordance with claim 4 wherein said plurality of series-resonating capacitors are provided in discreet component element form.

6. An improved ferrite antenna arrangement in accordance with claim 4 wherein said plurality of series-resonating capacitors are provided as thin, insulating pads suitably deposited between overlapping end portions of said respective pairs of said conductor wire segments.

7. An improved ferrite antenna arrangement in accordance with claim 4 wherein the number of wire segments and interconnecting series-resonating capacitors may be selected to provide a desired number of turns of said conductor on said magnetic core independent of terminal reactance required.

8. An improved ferrite antenna arrangement in accordance with claim 4 wherein said spiral conductor is in the form of a flat metallic ribbon.

* * * * *